US005875946A

United States Patent [19]

Knudsen

[11] Patent Number: 5,875,946

[45] Date of Patent: Mar. 2, 1999

[54] PORTAGE SYSTEM FOR LIGHT WATERCRAFT

[76] Inventor: Eric H. Knudsen, 755 Tyringham Rd., Lee, Mass. 01238

[21] Appl. No.: 910,886

[22] Filed: Aug. 13, 1997

[51] Int. Cl.[6] ..... A45F 3/08

[52] U.S. Cl. ..... 224/262; 224/263; 224/634; 224/636; 224/153; 114/343; 114/347; 383/3

[58] Field of Search ..... 224/153, 581, 224/582, 583, 184, 191, 627, 628, 633–636, 259–263; 114/343, 347; D12/302; 383/3

[56] References Cited

U.S. PATENT DOCUMENTS

| | | | |
|---|---|---|---|
| D. 391,916 | 3/1998 | Masters | D12/302 |
| 3,282,483 | 11/1966 | Babcock | 224/263 |
| 3,648,907 | 3/1972 | Romney . | |
| 3,734,367 | 5/1973 | Jackson . | |
| 3,897,894 | 8/1975 | Lawrence | 224/261 |
| 4,099,656 | 7/1978 | Neumann et al. | 383/3 |
| 4,357,894 | 11/1982 | Kirk | 114/347 |
| 4,593,841 | 6/1986 | Lange | 224/261 |
| 4,821,666 | 4/1989 | Ingram | 114/347 |
| 4,844,307 | 7/1989 | Rutledge . | |
| 4,884,731 | 12/1989 | Sibley . | |
| 5,407,112 | 4/1995 | Christodoulou et al. | 224/153 |
| 5,501,169 | 3/1996 | Denker | 114/347 |
| 5,547,246 | 8/1996 | Lambert | 297/129 |
| 5,577,457 | 11/1996 | Nichols, Jr. | 114/343 |

*Primary Examiner*—Allan N. Shoap
*Assistant Examiner*—Gregory M. Vidovich
*Attorney, Agent, or Firm*—Malcolm J. Chisholm, Jr.

[57] ABSTRACT

A portage system for supporting light watercraft such as a canoe or kayak includes a frame having opposed first and second upright arms, a plurality of cross-struts interconnecting the arms, a pair of shoulder straps secured to a cross strut and a hip belt secured adjacent bottom ends of the upright members to removably secure the frame to a user. First and second thwart cradles are adjustably secured to top ends of the first and second upright arms so that a center thwart of the watercraft may engage the first and second thwart cradles to support the watercraft at varying heights above the user. A balance strap is adjustably secured between a bottom end of an upright arm and a forward attachment point on the watercraft and tightened at a selected length by a slide buckle to prevent a rear end of the watercraft from descending below a selected height above a surface of the terrain the user is to portage in order to prevent the watercraft from banging into the obstructions on the surface and interrupting balance of the user, while enhancing forward visibility of the user. The thwart cradles can be adjusted to position the watercraft at one of a variety of heights above the user, the height being selected depending on the depth of the center thwart in the watercraft, and/or the length of the craft.

9 Claims, 2 Drawing Sheets

PORTAGE SYSTEM FOR LIGHT WATERCRAFT

BACKGROUND OF THE INVENTION

The present invention relates to devices for carrying light watercraft such as a canoe or kayak and for carrying camping materials associated with use of a canoe or kayak.

Users of canoes and modern touring kayaks frequently take long trips involving camping overnight in remote areas. Such adventures almost invariably require that a user carry or portage the light watercraft canoe or kayak along with adequate camping materials at least to a launch site some distance from a road, and frequently the users have to portage the watercraft and materials along uneven terrain between waterways. For example a first segment of a journey may be along a lake to a stream feeding into the lake, and a second segment may be along another lake nearby the stream, or upstream, beyond a region of rapids in the stream that the light watercraft cannot navigate. Frequently the distance that must be travelled between the first and second navigable segments is wooded, uneven terrain requiring substantial effort to portage both the watercraft and camping materials. Such portage distances most often range between 0.5 to 3 miles.

A traditional solution to that portage problem has been for one of the camping party to position a central portion of the watercraft such as a center thwart of a canoe over his or her shoulders so that the canoe is inverted and balanced on the shoulders. In that position, the user's head is within the canoe and therefore the user's visibility is severely limited. Typically the user would use at least one hand to balance the canoe in a stable position, while using the other hand for personal balance. It is well known that many modern canoes have center thwarts cut or molded to define a neck slot between flattened shoulder contact sections of the thwart to facilitate such traditional portage. While one party is carrying the watercraft in that manner, another party could carry any camping materials in a traditional back-pack or duffle bag type of arrangement, or if the user is alone, after portaging the canoe, the user could return to carry the materials to the launch site for the next segment of the trip.

Many problems are associated with this traditional solution. In particular, the entire weight of the watercraft is placed on the shoulders of the user causing rapid fatigue of shoulder musculature, and because of limitations on visibility, the user frequently causes the canoe to bang against tree trunks, protruding rocks, etc., which both damages the watercraft and may throw the user off balance. Additionally, because the user must keep one hand on the canoe, it is difficult to maintain balance especially over downhill or uphill slopes and rocky terrain, further adding to a risk of damaging the canoe through inadvertent contact, and even worse, raising a probability of the user stumbling to his or her own injury and hence causing potentially severe damage to a dropped watercraft, especially one with a fiberglass hull.

Many efforts have been made to overcome the problems associated with that traditional portage method for canoes. One proposed solution is a "Canoe Carrier" disclosed in U.S. Pat. No. 3,734,367 issued to Jackson on May 22, 1973. Jackson's canoe carrier includes a frame having shoulder straps secured to upper portions of opposed upright members that are secured to a user's shoulders and a hip belt secured to lower portions of the upright members and to a user's hips. The frame may support a traditional back-pack, and includes attachments on top ends of the upright members for receiving and supporting a center thwart of a canoe. A pair of support arms are pivotally connected to lower ends of the upright members and include attachment straps that secure the pair of support arms to a forward thwart or transverse strut of the canoe. The attachment straps secure the forward thwart in a fixed relationship to the frame on the user's back when the canoe is secured to the frame so that the watercraft cannot pivot about an axis perpendicular to the frame members or user's back.

Jackson's canoe carrier has not obtained popular usage because it gives rise to further problems, even though it has provided more comfort to the user by transferring weight of the watercraft to the frame. In particular, because the canoe is in a fixed, rigid relationship to the user, the user's visibility is severely restrained as he or she walks over uneven terrain. For example, if a user has to walk up an inclined slope, in order to see the slope the user will have to tilt the canoe so its forward portion moves upward. That motion will pull the user's hips forward because the support arms rigidly extend from the forward thwart to lower ends of the frame adjacent the user's hips, thereby jeopardizing the user's balance. Even worse is a situation wherein the user has to go down a substantial slope. In such a situation, a rear end of the canoe extending away from the user's back could contact a raised, or uphill slope behind the user, thereby forcing the canoe to pivot unexpectedly, so that the user would have to bend suddenly forward, and would very likely pitch forward, falling down the slope. A final problem with Jackson confronts the user in extricating her or himself from carrying the canoe without assistance from another person. First the straps securing the rigid support arms to the forward thwart must be disengaged by the user. Next the user must lift the canoe off of the support attachments on the frame and pivot the canoe so one end contacts the ground. Normally in such a motion, the front end is easily observed by the user as it is lowered to contact the ground, and the user then backs out of the canoe while holding it overhead until able to roll it upright and then let it down to the ground. However in such a traditional motion, the Jackson support arms would be in the way of any lowering of the forward end of the canoe. Consequently, a rear end of the canoe would have to be lowered to the ground first, but then the support arms would also be in the way of the user's arms in rolling the canoe over to the ground. Hence, Jackson's forward extending, rigidly affixed support arms severely compromise safe portage of a watercraft, and make unassisted removal of the canoe from the frame exceedingly awkward, if not impossible.

A similar and more recent effort to create a working light watercraft portage device is shown in U.S. Pat. No. 5,577,457 issued on Nov. 26, 1996 to Nichols, Jr. It shows a pair of pivotable support legs secured to a forward portion of a light watercraft that can be positioned to support the watercraft at an angle above the ground so that a user may get under the canoe to position a carrying yoke such as a center thwart on the user's shoulders. The support legs may then be pivoted into storage positions in the watercraft or they may be secured to a belt to help distribute the weight. While the support legs offer some flexibility in rough terrain to allow the user to move the canoe, they also require permanent fastening fixtures in the watercraft for both mounting and storing the legs, and no provision is made for assisting in moving camping materials. Consequently, the support legs of Nichols, Jr. have not gained wide-spread popularity as they are too complicated, heavy, costly to manufacture and install, and do not solve the most significant problems of watercraft portage, as they require the user to use at least one hand to balance the mounted watercraft during portage over rough terrain. The support legs only assist in mounting and disengaging a watercraft such as a canoe. Moreover, the legs could have no practical application for touring kayaks having hulls that are closed except for a user's cockpit.

Another recent attempt to provide an efficient light watercraft portage device is shown in U.S. Pat. No. 5,547,246 issued on Aug. 20, 1996 to Lambert. Like Jackson, Lambert also shows a frame secured to a user's back, but the Lambert frame consists of two rectangular frames pivotally connected so that a carrier belt holds the two frame members sufficiently apart when on the user's back to support a central strut of a light watercraft immediately adjacent the user's shoulders. The carrier belt also holds the webbed frame members in a position of a camp chair when deployed on the ground. While the Lambert carrier eliminates the fixed positional problems of Jackson and achieves a weight distribution from the user's shoulders to the frame, Lambert still fails to resolve major problems associated with traditional canoe portage requirements. With Lambert's carrier, the user's head is still projected within the hull of a watercraft such as a canoe giving rise to visibility problems. Those problems are expected to be resolved by the user pivoting the supported canoe with one hand while balancing with the other. Lambert therefore leaves the user with most of the basic problems of traditional portage once the watercraft is mounted; namely, visibility and related balance limitations leading to risks of damage to the watercraft from banging into objects, and risks of loss of balance to the user in rough, uneven terrain resulting in falling and possible injury to the user and severe damage to the watercraft.

Accordingly, it a general object of the present invention to provide a portage system for light watercraft that overcomes the problems of the prior art.

It is a more specific object to provide a portage system for light watercraft that enables a user to use both hands while the watercraft is supported above the user's head while limiting unintended contact between the craft and foreign objects.

It is yet another specific object to provide a portage system for light watercraft that may be used on a variety of watercraft, such as canoes and single and double touring kayaks.

It is a further object of the present invention to provide a portage system that may be utilized to carry either a light watercraft, camping material, or both, and to enable rapid disengagement of the camping material from the system to quickly switch to carrying the watercraft alone.

These and other advantages and objects of this invention will become more readily apparent when the following description is read in conjunction with the accompanying drawings.

SUMMARY OF THE INVENTION

A portage system for supporting light watercraft is disclosed. In a particular embodiment, the portage system includes a frame having opposed first and second upright arms, a plurality of cross-struts interconnecting the arms, a pair of shoulder straps secured to a cross strut and a hip belt secured adjacent bottom ends of the upright members to removably secure the frame to a user; first and second thwart cradles adjustably secured to top ends of the first and second upright arms so that a center thwart of the watercraft may engage the first and second thwart cradles to support the watercraft at varying heights above the user; and a balance strap adjustably secured between a bottom end of an upright arm and a forward attachment point on the watercraft. The thwart cradles include adjustment means such as a standard plurality of throughbores passing through a stem of each cradle that are dimensioned to be aligned with a throughbore passing through the upright arms adjacent their top ends so that a lock rod may pass through the arm and a throughbore of the stem of the cradle selected to position the watercraft at one of a variety of heights above the user; the height being selected depending on the depth of the center thwart in the watercraft, and/or the length of the craft.

In use of the portage system for supporting light watercraft, the thwart cradles are first secured to the upright arms in selected positions, the user then mounts the frame on her or his back in a traditional fashion having the hip belt tightened to transfer the weight of the frame to the user's hips. A watercraft having a central strut over a top center portion of the hull, such as a center thwart of a standard canoe is then lifted at one end and inverted by the user. The user then raises that end over his or her head, and walks toward the center thwart and lowers it onto the thwart cradles. A rear end of the watercraft extending away from the user's back side is then raised and held at a desired level above the terrain surface depending upon the slope of the terrain to be covered by the user, such as four feet above the surface. The balance strap is then secured between the bottom end of one of the upright arms and the forward attachment point on the watercraft such as a forward thwart, and the strap is adjusted by a traditional slide buckle to be taught while the watercraft is in the desired alignment relative to the terrain surface, wherein the rear end of the craft is about four feet above the surface. When the user commences walking, because the portage system raises the watercraft a desired level above the user, the craft does not disrupt the user's forward visibility of the terrain surface especially on slopes, and the weight of the watercraft is comfortably transferred through the frame to the user's hips. Additionally, the balance strap prevents the rear end of the watercraft from pivoting into contact with the terrain surface as long as the surface adjacent the rear end of the craft is less than four feet above the terrain surface upon which the user is standing. Consequently, the user has both of her or his hands free for balance during portage, while having the watercraft raised well above the user and selectively adjusted at an angle appropriate for the specific terrain being covered.

In a preferred embodiment, the portage system includes a watercraft bag that has quick frame release fasteners for securing and quickly releasing the bag from the frame so that a user may first transport the watercraft, and then return without taking off the frame to quickly portage the bag to the next launch or camp site. In additional embodiments, the portage system includes kayak center thwarts that can readily be secured to standard touring kayaks to enable them to also be supported in the thwart cradles in the same manner as a traditional canoe watercraft.

DETAILED DESCRIPTION OF THE PREFERRED EMBODIMENTS

Figure 1:
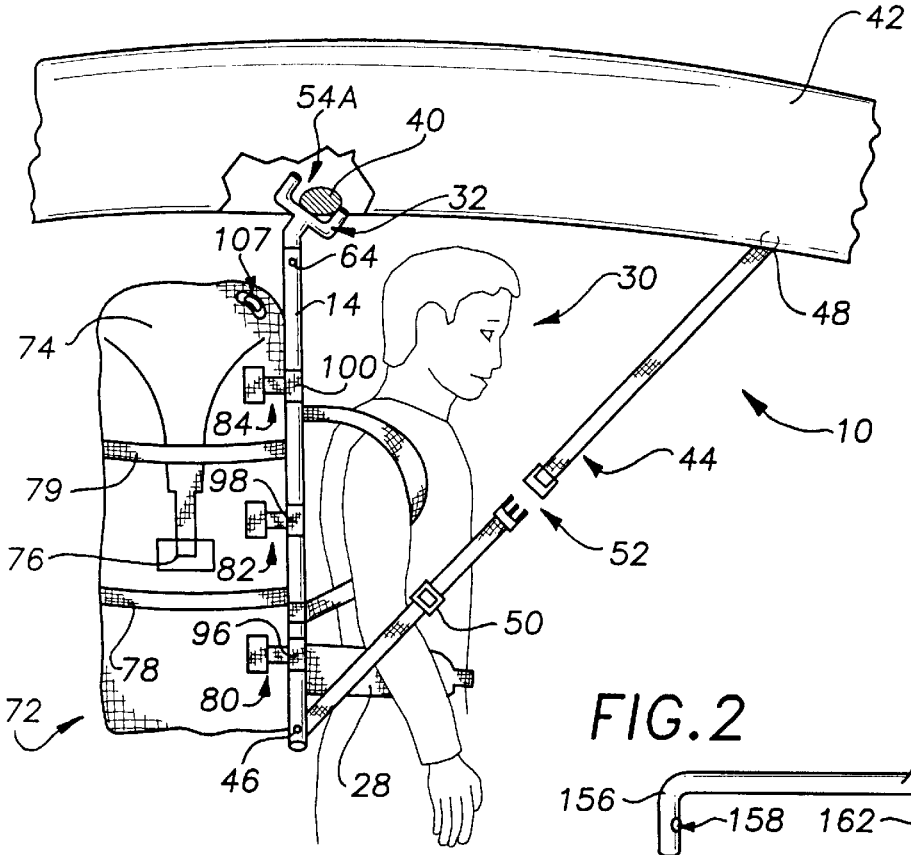
FIG. 1 is a side perspective view of a portage system for light watercraft constructed in accordance with the present invention, wherein a user of the system is shown supporting a watercraft.
Figure 2:
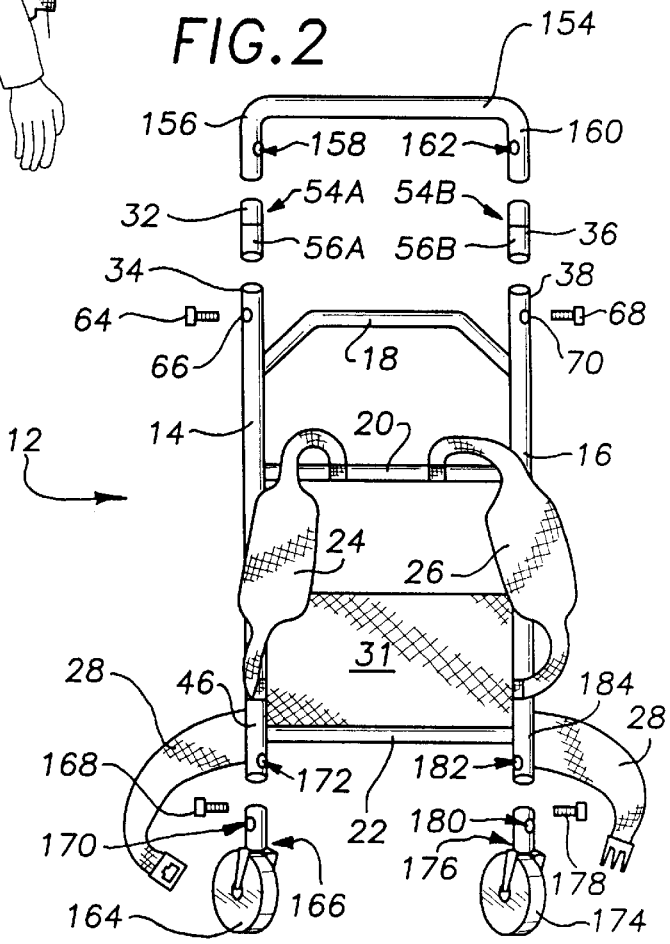
FIG. 2 is a front perspective view of a frame of the FIG. 1 portage system.

Referring to the drawings in detail, a portage system for light watercraft is shown and generally designated by the reference numeral 10. As best seen in FIGS. 1 and 2, the portage system 10 basically includes a frame 12 having a first upright arm 14, interconnected to a second upright arm 16, by a first cross-strut 18, a second cross-strut 20 and a third cross-strut 22, and a first shoulder strap 24 secured between the second cross-strut 20 and the first upright arm 14, a second shoulder strap 26 secured between the second cross-strut 20 and the second upright arm 16 with a hip belt 28 to secure the frame to a user 30 of the portage system in a traditional fashion best seen in FIG. 1. The frame 12 may also include a mesh lumbar support pad 31 secured between the first and second upright arms 14, 16 adjacent the hip belt 28 and third cross strut 22 in a well known manner. A first thwart cradle 32 is adjustably secured to a top end 34 of the first upright arm 14, and a second thwart cradle 36 is adjustably secured to a top end 38 of the second upright arm 16 so that a central strut of a watercraft such as a center thwart 40 of a canoe watercraft 42 (shown in FIG. 1) may engage the first and second thwart cradles 32, 36 to support the canoe 42 at varying heights above the user 30.

A balance strap 44 is secured between a bottom portion of the frame 12 such as a bottom portion of one of the upright arms 14, 16 of the frame 12, such as bottom portion 46 of the first upright arm 14, and a forward attachment point 48 of the watercraft 42, such as a forward thwart, seat or rope securing cleat (not shown). The balance strap 44 includes a slide buckle means for adjusting the strap to a tight or taught position of conventional design such as a figure "8" shaped metal bracket 50 through which the strap slides twice to adjustably tighten the strap 44. The slide buckle means may also be any standard buckle or knot that allows a user to adjust a length of strap to be tightened at a selected length. The balance strap may also include a strap quick release buckle means for quickly disengaging the strap 44 from the watercraft 42, such as a standard strap compression clip buckle 52 of the type commonly used on chin straps of modern protective bicycle helmets.

Figure 4:
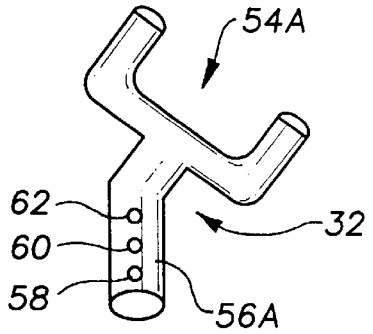
FIG. 4 is a perspective view of a first thwart cradle of the FIG. 1 portage system.

As best seen in FIGS. 2 and 4, each thwart cradle 32, 36 includes a cradle slot 54A, 54B supported by a cradle stem 56A, 56B dimensioned to be adjustably and removably secured to the top ends 34, 38 of the first and second upright arms 14, 16. The thwart cradles 32, 36 also include adjustment means for positioning the thwart cradle slots 54A, 54B at various heights above the first and second upright arms 14, 16, such as a standard arrangement of first, second and third positioning throughbores 58, 60, 62 (shown in FIG. 4) defined in each cradle stem 56A, 56B. The cradle stems 56A, 56B pass over (as seen in FIG. 2), or insert into the top ends 34, 36 of the first and second upright arms 14, 18 and are secured at a selected height above the user 30 by passing a first lock rod 64 through a first upright throughbore 66 defined adjacent the top end 34 of the first upright arm 14 when it is aligned with the selected first, second or third positioning throughbore 58, 60, 62 of the first thwart cradle 32, and by passing a second lock rod 68 through a second upright throughbore 70 defined adjacent the top end 38 of the second upright arm 16 when aligned with the selected first, second or third positioning throughbore 58, 60, 62 of the second thwart cradle 36. Any known adjustment means for positioning a stem above an arm may be used to provide adjustable positioning of the first and second thwart cradles 32, 36 above the first and second upright arms 14, 16, such as a standard threaded screw and corresponding threaded sleeve arrangement, etc.

Figure 3:
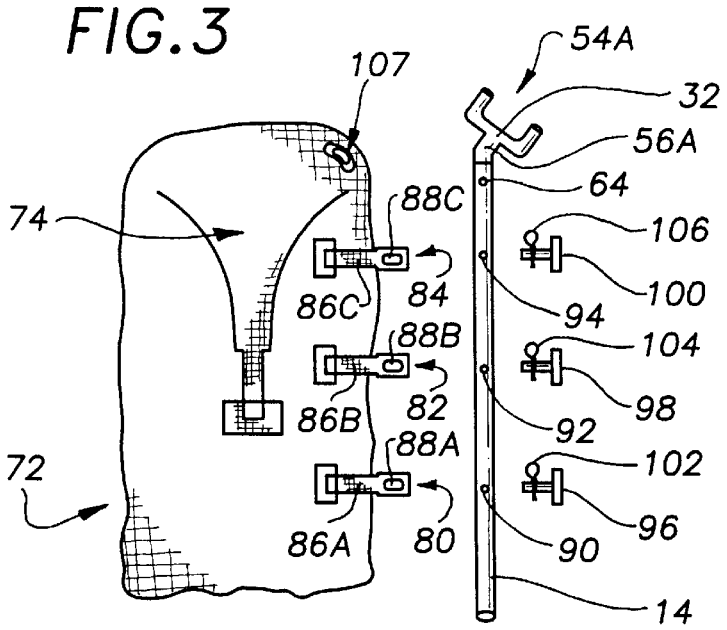
FIG. 3 is a side plan view of an upright arm of the FIG. 2 frame showing a watercraft bag having quick frame release fasteners for securing the bag to the arm.

As seen in FIGS. 1 and 3, a preferred embodiment of the portage system 10 also may include a watercraft bag 72 for transporting camping and related materials. Bags for wet environments common to water sports, referred to generally as "dry bags", are made of waterproof materials of a construction similar to the watercraft bag 72. Typically such bags are designed to be readily stowed in a hull of a watercraft while maintaining the enclosed materials dry. The watercraft bag 72 of the portage system 10 includes a waterproof closure top seal 74 that extends into a closure buckle 76 on each side, along with first and second compression straps 78, 79 that compress the bag to keep excess air out of the bag, and to assist the bag in maintaining as small a profile as possible, in much the same way a traditional sleeping bag (not shown) is compressed after being rolled up.

The watercraft bag 72 of the present invention includes quick frame release means for quickly releasing the bag 72 from the frame 12, such as first, second and third quick frame release fasteners 80, 82, 84, shown in FIGS. 1 and 3 on a side of the bag 72 adjacent a right side of the user 30. (The bag 72 would also include fourth, fifth and sixth quick frame release fasteners on an opposed side of the bag 72 which is not shown the Figures.) Each such quick frame release fastener 80, 82, 84 includes a first, second and third slotted strap 86A, 86B, 86C extending away from the bag 72 toward the adjacent first upright arm 14 of the frame 12; a strap slot 88A, 88B, 88C defined in each of the straps and dimensioned to correspond with first, second and third frame release slots 90, 92, 94 defined in the first upright arm 14; and first, second and third frame lock rods 96, 98, 100 that are dimensioned to pass through the respective first, second or third frame release slots 90, 92, 94 and the strap slots 88A, 88B, 88C, of the first, second and third slotted straps 86A, 86B, 86C, and be secured therewithin by first, second and third bridge pins 102, 104, 106 in a well known manner. To connect the watercraft bag 72 to the frame 12, the user simply passes the third frame lock rods 96, 98, 100 through the first, second or third frame release slots 90, 92, 94 and the strap slots 88A, 88B, 88C, of the first, second and third slotted straps 86A, 86B, 86C and secures the lock rods 96, 98, 100 with their first, second and third bridge pins 102, 104, 106, and repeats the operation for the fourth, fifth and sixth quick frame release fasteners (not shown) on an opposed side of the bag to the second upright arm 14. As is apparent, to disconnect the watercraft bag 72, the user simply disconnects the bridge pins 102, 104 and 105 and lock rods 96, 98, 100 from the slotted straps 86A, 86B, 86C and then stores the lock rods 96, 98, 100 in the first, second and third frame release slots 90, 92, 94. Traditional "back packs" and associated frames have complex strap and sleeve components to securely fasten the back pack to the frame in a fixed position for long periods of time while camping as it is not ordinarily contemplated to quickly disconnect such a back pack from the frame other than for cleaning purposes. The quick frame release means for quickly releasing the bag 72 from the frame 12 may include any of a variety of similar fasteners that can be used to quickly disconnect the bag 72 from the frame, such as standard compression clip buckles secured to corresponding straps extending from both the bag 72 and the frame 12 (not shown), etc.

The watercraft bag 72 may also include a two-way air valve means for facilitating passage of air into and out of the watercraft bag 72, such as two-way air valve 107. The two-way air valve 107 is similar to valves commonly used on modern air mattresses and 2–3 person inflatable pleasure boats. In an air entry mode, the two-way air valve 107 permits air to be blown into the bag by the user's mouth or by a small hand pump (not shown) and the valve prohibits discharge of the air between breaths or pump strokes. In an air exit mode, the valve permits unrestricted, rapid discharge of air from the inflated watercraft bag 72. In use of the two-way air valve 107, a user would use the valve to add air to an interior of the bag housing camping goods to increase buoyancy of the bag while the watercraft bag 72 is stored in a watercraft to lessen any chances of the bag 72 sinking if the watercraft were to capsize. During portage of the watercraft bag 72, the user would use the two-way air valve 107 in conventional fashion to hasten discharge of air from the bag as the compression straps 78, 79 reduce the bag 72 to a small displacement volume for convenience of securing the bag 72 to the frame 12.

Figure 5:
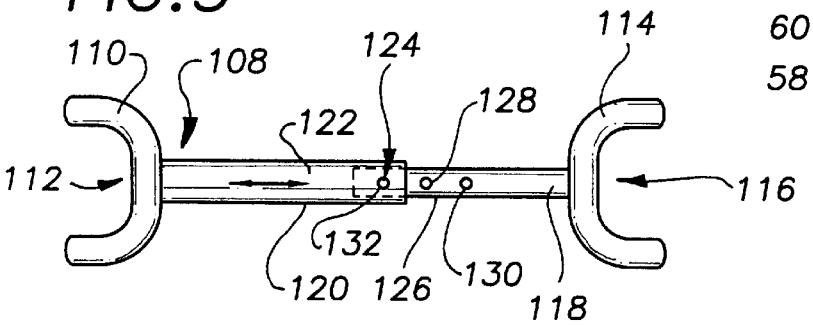
FIG. 5 is a plan view of an adjustable kayak center thwart of the portage system for light watercraft of the present invention.
Figure 6:
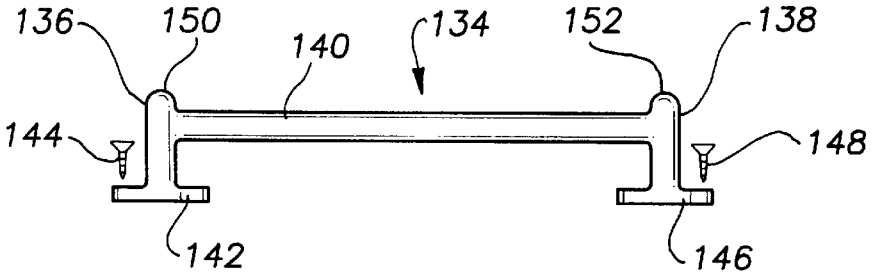
FIG. 6 is a plan view of a tandem adaptor kayak center thwart of the portage system for light watercraft of the present invention.

As shown in FIGS. 5 and 6, the portage system also includes portable kayak center thwarts that can be secured to a standard touring kayak so that they can be supported in the first and second thwart cradles 32, 34. One such kayak center thwart is an adjustable kayak center thwart 108 (shown in FIG. 5) for usage in a "single" touring kayak. As is well known, a single touring kayak (not shown) has a closed hull and a cockpit near or at the center of gravity of the hull for a user to sit in while paddling, and the cockpit has a ridge or cockpit gunwale surrounding its opening.

The adjustable kayak center thwart includes a first clamp end 110 that defines a first clamp notch 112 and a second clamp end 114 that defines a second clamp notch 116, the ends 110, 114 being interconnected by a support bar 118. The bar 118 includes a bar length adjustment means for adjusting a length of the bar, such as a slide lock 120. The slide lock 120 includes a sleeve end 122 of the support bar 118 that defines a sleeve throughbore 124, the sleeve end 122 being dimensioned to slide over an insertion end 126 of the bar 118. The insertion end 126 defines a plurality of insertion throughbores, such as first and second insertion throughbores 128, 130 dimensioned to receive a bar lock rod 132 that passes through the sleeve throughbore 124 and either the first or second insertion throughbores 128, 130 in a well known manner to adjustably secure the adjustable kayak center thwart 108 in one of several possible lengths. To use the adjustable kayak center thwart 108, the bar lock rod 132 is removed and the insertion end 126 of the support bar 118 is slid into the sleeve end 122 so that the thwart 108 is narrower than a diameter of the cockpit of the single kayak perpendicular to its keel. The adjustable kayak center thwart 108 is then inserted into the kayak cockpit (not shown) and then the insertion end 126 is removed out of the sleeve end 122 until both the first clamp notch 112 and second clamp notch 116 engage the cockpit gunwale so that the thwart 108 is aligned to be perpendicular to the keel of the kayak. The bar lock rod 132 is then inserted into the sleeve throughbore 124 and through an underlying first or second insertion throughbore 128, 130 to lock the adjustable kayak center thwart 108 in a fixed position, so the user 30 can then position thwart in the first and second thwart cradles 32, 36 to support and portage the kayak in the same manner as the canoe watercraft 42.

An additional kayak center thwart is a tandem adaptor kayak center thwart 134 shown in FIG. 6. The tandem adaptor kayak center thwart allows a user to support a double or tandem kayak with the portage system 10. The tandem adaptor kayak center thwart 134 includes a first ridge end 136 and a second ridge end 138 interconnected by a tandem bar 140; and a first and second tandem securing means for securing the thwart 134 to a top center portion of a hull of a tandem kayak, such as first tandem securing plate 142 and associated first threaded fastener 144, and a second tandem securing plate 146 and associated second threaded fastener 148, both of which threaded fasteners 144, 148 secure their respective first and second plates 142, 146 to a kayak hull through throughbores (not shown) in the plates 142, 146 in a conventional fashion. The first ridge end 136 of the tandem kayak center thwart 134 defines a first ridge 150 and the second ridge end of the thwart 134 defines a second ridge 152 raised above the tandem bar 140. In use of the tandem adaptor kayak center thwart 134, a user 30 secures the thwart 134 on top of a hull of a tandem or double kayak adjacent the center of gravity of the kayak so that the thwart 134 is perpendicular to the keel. Then the user simply positions the tandem bar 140 in the first and second thwart cradles 32, 36 as with the canoe watercraft 42, so that the first and second ridges 150, 152 of the tandem bar 140 project below the first and second cradle slots 54A, 54B to prevent the tandem bar 140 from sliding out of the thwart cradles 32, 36 as the user portages the tandem kayak.

As seen in FIG. 2, a further embodiment of the portage system 10 includes wheeled transport means for assisting movement of the frame 12 and secured watercraft bag over smooth surfaces such as airport walkways or pavement. The wheeled transport means includes an extension bar 154 removably secured to the frame 12 when the first and second thwart cradles 32, 36 are removed, and first and second caster wheels 164, 174 secured to the first and second upright arms 14, 16. The extension bar 154 includes a first insertion end 156 dimensioned to fit over the top end 34 of the first upright arm 14 and defining a first extension throughbore 158 dimensioned to receive the first lock rod 64 to secure the first insertion end 156 to the first upright arm 14. The extension bar also includes a second insertion end 160 dimensioned to fit over the top end 38 of the second upright arm 16 and defining a second extension throughbore 162 dimensioned to receive the second lock rod 68 to removably secure the second insertion end to the second upright arm 16. The first caster wheel 164 is supported by a standard first caster frame 166 and is dimensioned to be removably secured to the first upright arm 14 of the frame 12 by a first caster lock rod 168 passing through a first caster frame throughbore 170 and corresponding first caster arm throughbore 172 in the bottom portion 46 of the first upright arm 14. The second caster wheel 174 is supported by a standard first caster frame 176 and is dimensioned to be removably secured to the second upright arm 16 of the frame 12 by a second caster lock rod 178 passing through a second caster frame throughbore 180 and corresponding second caster arm throughbore 182 in a bottom segment 184 of the second upright arm 16. The wheeled transport means may include any standard wheeled or friction reducing components secured to the first and second upright arms 14, 16 combined with any handle secured to the frame, such as the first cross strut (if the bag 72 is for example only partially filled), so that the user 30 may readily drag the frame 12 across the smooth surface.

In use of the portage system 10 for supporting light watercraft such as a canoe watercraft 42, the user 30 first secures the first and second thwart cradles 32, 36 at a selected height position relative to the first and second upright arms 14, 16, and then mounts the frame to the user's back in a traditional manner having the hip belt 28 secured to transfer weight through the frame to the user's hips. A central strut of a watercraft such as a center thwart 40 of a canoe watercraft is then lifted at one of its ends by the user and inverted so that the center thwart is positioned across the first and second cradle slots 54A, 54B of the first and second thwart cradles 32, 36. In such a position, the watercraft is then positioned well above the user so that visibility is enhanced during portage. The user then may position the canoe 42 so that its rear end extending away from the user's back side is positioned at a desired height above the surface of the terrain over which the user is to portage the canoe, such as five feet above the surface. The height would be selected depending on the severity of any down slopes or up slopes on the surface, and the desired visibility. The closer to the surface of the terrain the rear end is positioned, the greater the visibility. However, if substantial down slopes are anticipated, the user 30 may position the watercraft 42 level to the surface, or even tilted forward a slight amount.

After the desired height above the surface of the terrain is selected, the user secures the balance strap 44 between the bottom portion of the first or second upright arms 46, 184 and a forward attachment point 48 of the canoe 42, and then adjusts the balance strap's slide buckle 50 so that the strap 44 is taught. The user 30 then proceeds to portage the watercraft 42, and as uneven terrain is encountered, the balance strap prohibits the rear end of the watercraft from descending so close to the surface of the terrain as to contact an obstruction such as a boulder, tree trunk, etc., thereby minimizing any chance of damage to the watercraft, and interruption in the balance of the user that could lead to a fall.

Upon arrival at an intended destination such as a new watercraft launch site or camping site, the user 30 simply disconnects the strap buckle 52 located on the balance strap 44 so that the strap falls away, and the user then tilts the watercraft so that a front end opposed to the rear end contacts the terrain surface. Next the user 30 lifts the center thwart 40 off of the first and second thwart cradles and backs away toward the back end of the canoe 42 until she or he is able to comfortably invert the canoe to an upright position to then set it on the terrain surface. Alternatively, after disconnecting the balance strap 44, the user of a light-weight watercraft may simply lift the center thwart out of the thwart cradles 32, 36 and invert the watercraft while lowering it to the ground to her or his side. Associated usage of the watercraft bag 72 and any kayak center thwarts may likewise be readily facilitated by the portage system 10 for light watercraft as described above.

While the present invention has been described and illustrated with respect to a particular construction of a portage system for light watercraft, it will be understood by those skilled in the art that the present invention is not limited to the above described examples and embodiments. Accordingly, reference should be made primarily to the attached claims rather than to the foregoing specification to determine the scope of the invention.

What is claimed is:

1. A portage system for supporting light watercraft, comprising:

a. a frame having opposed first and second upright arms interconnected by a plurality of cross struts, a pair of shoulder straps secured to a cross strut and a hip belt secured to bottom portions of the arms to removably secure the frame to a user;

b. a first thwart cradle adjustably secured to a top end of the first upright arm, and a second thwart cradle adjustably secured to a top end of the second upright arm so that a central strut of a watercraft may engage first and second cradle slots of the first and second thwart cradles to be adjustably supported at varying heights above the user, the first and second thwart cradles including adjustment means for positioning the first and second cradle slots at varying heights above the first and second upright arms; and, c. a portable kayak center thwart securable to a kayak including a bar dimensioned to engage the first and second thwart slots, wherein the portable kayak center thwart is an adjustable kayak center thwart including a first clamp end defining a clamp notch and a second clamp end defining a second clamp notch, the clamp ends interconnected by a support bar including a bar length adjustment means for adjusting a length of the bar, so that the kayak center thwart may be shortened to fit into a cockpit of a kayak and lengthened to position the first and second clamp notches to engage a cockpit gunwale perpendicular to a keel of the kayak.

2. A portage system for supporting light watercraft, comprising:

a. a frame having opposed first and second upright arms interconnected by a plurality of cross struts, a pair of shoulder straps secured to a cross strut and a hip belt secured to bottom portions of the arms to removably secure the frame to a user;

b. a first thwart cradle adjustably secured to a top end of the first upright arm, and a second thwart cradle adjustably secured to a top end of the second upright arm so that a central strut of a watercraft may engage first and second cradle slots of the first and second thwart cradles to be adjustably supported at varying heights above the user, the first and second thwart cradles including adjustment means for positioning the first and second cradle slots at varying heights above the first and second upright arms; and, c. a balance strap securable between a bottom portion of the frame and a forward attachment point of the watercraft in front of the user wherein the balance strap includes a slide buckle means for selectively adjusting the strap to a tight position so that the strap becomes tight and thereby prevents a rear end of the watercraft behind the user from pivoting about its central strut to descend below a selected height above a terrain surface over which the user is portaging the watercraft.

3. The portage system for supporting light watercraft of claim 2, wherein the system further comprises a watercraft bag removably secured to the frame, the watercraft bag including quick frame release means for quickly releasing the bag from the frame.

4. The portage system for supporting light watercraft of claim 3, wherein the watercraft bag includes a two-way air valve means for facilitating passage of air into and out of the watercraft bag.

5. The portage system for supporting light watercraft of claim 4, wherein the means for quickly releasing the bag from the frame comprises a plurality of quick release fasteners, each fastener including a slotted strap extending away from the bag and defining a strap slot dimensioned to correspond with a frame release slot defined in the upright arms so that a frame lock rod passes through the strap slot and frame release slot to secure the bag to the frame.

6. The portage system for supporting light watercraft of claim 5, wherein the system further comprises a portable kayak center thwart securable to a kayak including a bar dimensioned to engage the first and second thwart slots.

7. The portage system for supporting light watercraft of claim 6, wherein the portable kayak center thwart is an adjustable kayak center thwart including a first clamp end defining a clamp notch and a second clamp end defining a second clamp notch, the clamp ends interconnected by a support bar including a bar length adjustment means for adjusting a length of the bar, so that the kayak center thwart may be shortened to fit into a cockpit of a kayak and lengthened to position the first and second clamp notches to engage a cockpit gunwale perpendicular to a keel of the kayak.

8. The portage system for supporting light watercraft of claim 6, wherein the portable kayak center thwart is a tandem adaptor kayak center thwart including a first ridge end and a second ridge end interconnected by a tandem bar and first and second tandem securing means for securing the tandem adaptor kayak center thwart to a tandem kayak so that the tandem bar is perpendicular to a keel of the tandem kayak.

9. The portage system for supporting light watercraft of claim 5, wherein the first and second thwart cradle adjustment means comprise a plurality of positioning throughbores defined in a first and second cradle stem of each of the first and second thwart cradles, wherein the first and second cradle stems are dimensioned to cooperate with the first and second upright arms of the frame so a first lock rod passes through a selected positioning throughbore of the first cradle stem and through a first upright throughbore adjacent the top end of the first upright arm to secure the first cradle slot in a selected position above the first upright arm, and a second lock rod passes through a selected positioning throughbore of the second cradle stem and through a second upright throughbore adjacent the top end of the second upright arm to secure the second cradle slot in a selected position above the second upright arm.

* * * * *